US010349720B2

(12) United States Patent
Lin

(10) Patent No.: US 10,349,720 B2
(45) Date of Patent: Jul. 16, 2019

(54) COSMETIC POWDER BOX WITH A MAGNETIC POSITIONING STRUCTURE

(71) Applicant: Libo Cosmetics Co., Ltd., Changhua County (TW)

(72) Inventor: Hsiao-Yun Lin, Changhua County (TW)

(73) Assignee: Libo Cosmetics Co., Ltd., Changhua County (TW)

( * ) Notice: Subject to any disclaimer, the term of this patent is extended or adjusted under 35 U.S.C. 154(b) by 0 days.

(21) Appl. No.: 16/028,893

(22) Filed: Jul. 6, 2018

(65) Prior Publication Data

US 2018/0310688 A1 Nov. 1, 2018

Related U.S. Application Data

(63) Continuation-in-part of application No. 14/959,924, filed on Dec. 4, 2015, now abandoned.

(51) Int. Cl.

| | |
|---|---|
| ***A45D 33/20*** | (2006.01) |
| ***A45D 33/00*** | (2006.01) |
| ***B65D 43/20*** | (2006.01) |
| ***B65D 21/08*** | (2006.01) |
| *A45D 40/24* | (2006.01) |

(52) U.S. Cl.

CPC ..... *A45D 33/003* (2013.01); *A45D 33/20* (2013.01); *B65D 21/086* (2013.01); *B65D 43/20* (2013.01); *A45D 33/006* (2013.01); *A45D 40/24* (2013.01)

(58) Field of Classification Search

CPC ..... A45D 33/20; A45D 40/24; A45D 33/003; B65D 21/086; B65D 43/20

USPC ..... 220/8

See application file for complete search history.

(56) References Cited

U.S. PATENT DOCUMENTS

| | | | |
|---|---|---|---|
| 4,898,195 | A | 2/1990 | Sussman |
| 6,831,541 | B1 | 12/2004 | Seidler |
| 7,467,440 | B2 | 12/2008 | Seidler |
| 2013/0126691 | A1 | 5/2013 | Miklas |

*Primary Examiner* — Anthony D Stashick
*Assistant Examiner* — Raven Collins
(74) *Attorney, Agent, or Firm* — Bruce Stone LLP; Joseph Bruce

(57) ABSTRACT

A cosmetic powder box includes an outer box having a longitudinal hole. A first magnetically attractive member is embedded in each end of the outer box. The inner box includes a top side having grooves for receiving cosmetic items. The inner box is slideable relative to the outer box along the longitudinal axis between a retracted position received in the outer box and an extended position partially exposed on a left or right side of the outer box. A second magnetically attractive member is embedded in each end of a bottom side of the inner box and is aligned with and in magnetic attraction with one of the first magnetically attractive members when the inner box is in the retracted position. One of the second magnetically attractive members is aligned with and in magnetic attraction with the other first magnetic member when the inner box is in the extended position.

20 Claims, 7 Drawing Sheets

COSMETIC POWDER BOX WITH A MAGNETIC POSITIONING STRUCTURE

CROSS REFERENCE TO RELATED APPLICATION[S]

This application is a continuation-in-part of the earlier U.S. Utility patent application to entitled "COSMETIC POWDER BOX WITH A MAGNETIC POSITIONING STRUCTURE," Ser. No. 14/959,924, filed Dec. 4, 2015, now pending, the disclosure of which is hereby incorporated entirely herein by reference.

BACKGROUND OF THE INVENTION

The present invention relates to a cosmetic powder box and, more particularly, to a cosmetic powder box with a magnetic positioning structure to position an inner box slideably received in an outer box.

A cosmetic powder box has substantially circular cross sections and is of a bivalves design for opening and closing purposes. However, the cosmetic powder box of this type has a smaller receiving space and, thus, receives limited types of cosmetic items. Furthermore, the cosmetic powder box can only be opened from a side thereof; namely, the cosmetic powder box cannot be opened from the other side, providing limited application states and, hence, requiring improvement.

Thus, a need exists for a novel cosmetic powder box to mitigate and/or obviate the above disadvantages.

BRIEF SUMMARY OF THE INVENTION

The primary objective of the present invention is to provide a cosmetic powder box including an inner box slideably received in an outer box. The inner box is positioned relative to the outer box by a magnetic positioning structure when the inner box is in an extended position or a retracted position.

The above objective is fulfilled by a cosmetic powder box including an outer box having two ends spaced from each other along a longitudinal axis. The outer box is tubular and has rectangular cross sections. The outer box includes a longitudinal hole having two openings in the two ends of the outer box. A first magnetically attractive member is embedded in a perimeter wall defining each of the two openings. An inner box is received in the outer box. The inner box includes a top side having a plurality of grooves adapted for receiving cosmetic items. The inner box is slideable relative to the outer box along the longitudinal axis between a retracted position received in the outer box and an extended position partially exposed on a left side or a right side of the outer box. The inner box further includes a bottom side opposite to the top side. A second magnetically attractive member is embedded in each of two ends of the bottom side of the inner box. Each second magnetically attractive member is aligned with and in magnetic attraction with one of the first magnetically attractive members when the inner box is in the retracted position. One of the second magnetically attractive members is aligned with and in magnetic attraction with the other of the first magnetic members when the inner box is in the extended position.

Each of the two ends of the bottom side of the inner box can include an embedding groove. Each second magnetically attractive member can be embedded in one of the embedding grooves.

The outer box includes a bottom wall having two ends. An embedding groove can be defined in each of the two ends of the bottom wall of the outer box. Each first magnetically attractive member can be embedded in one of the embedding grooves.

The present invention will become clearer in light of the following detailed description of illustrative embodiments of this invention described in connection with the drawings.

DETAILED DESCRIPTION OF THE INVENTION

With reference to FIGS. 1-5 and FIG. 5A, a cosmetic powder box with a magnetic positioning structure according to the present invention includes an outer box 10 and an inner box 20. The outer box 10 includes two ends spaced from each other along a longitudinal axis. the outer box 10 is tubular and has rectangular cross sections. The outer box 10 includes a longitudinal hole having two openings 11 in the two ends of the outer box 10. A first magnetically attractive member 12 is embedded in a perimeter wall defining each of the two openings 11.

Figure 1:
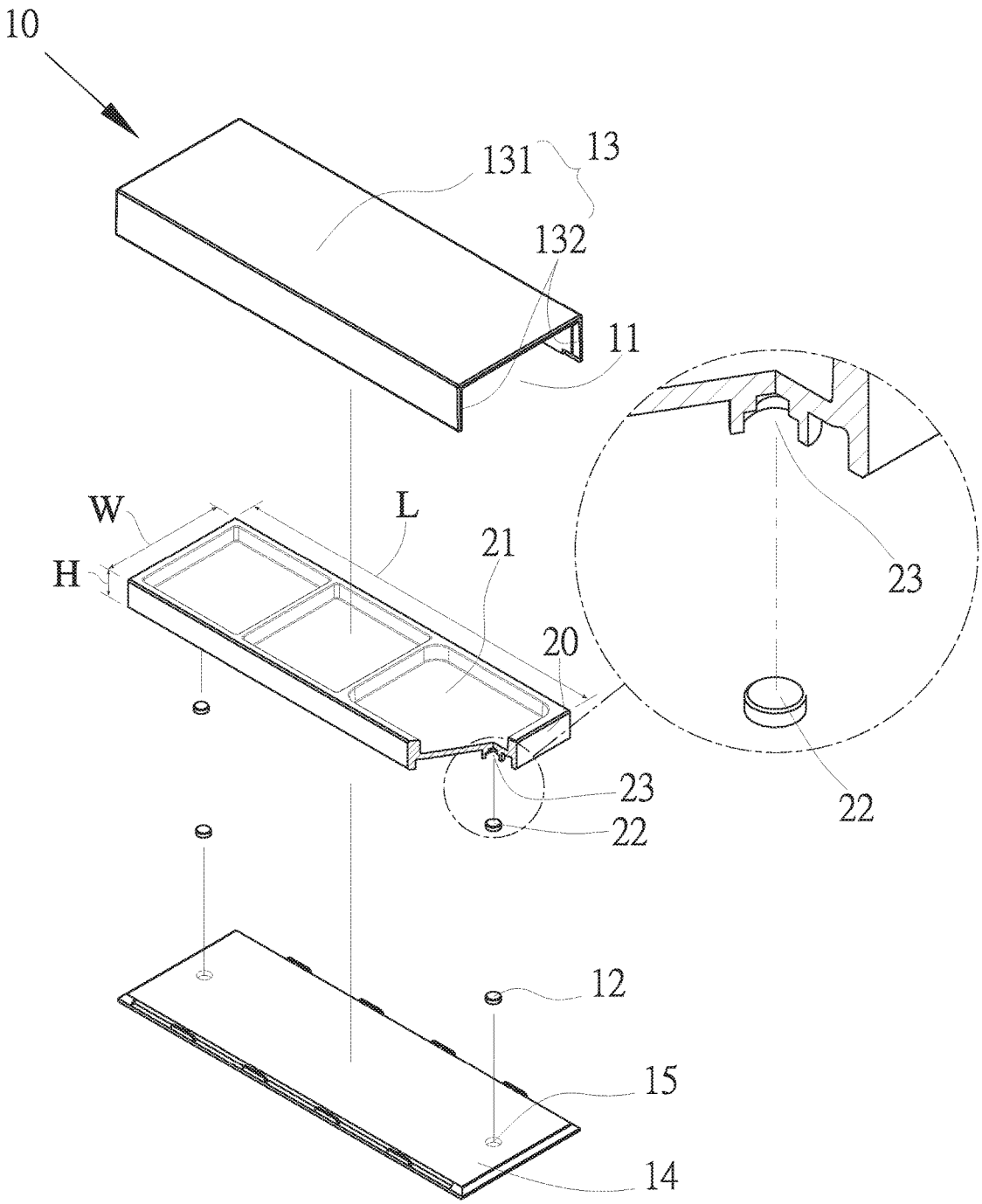
FIG. 1 is an exploded, perspective view of a cosmetic powder box according to the present invention.
Figure 2:
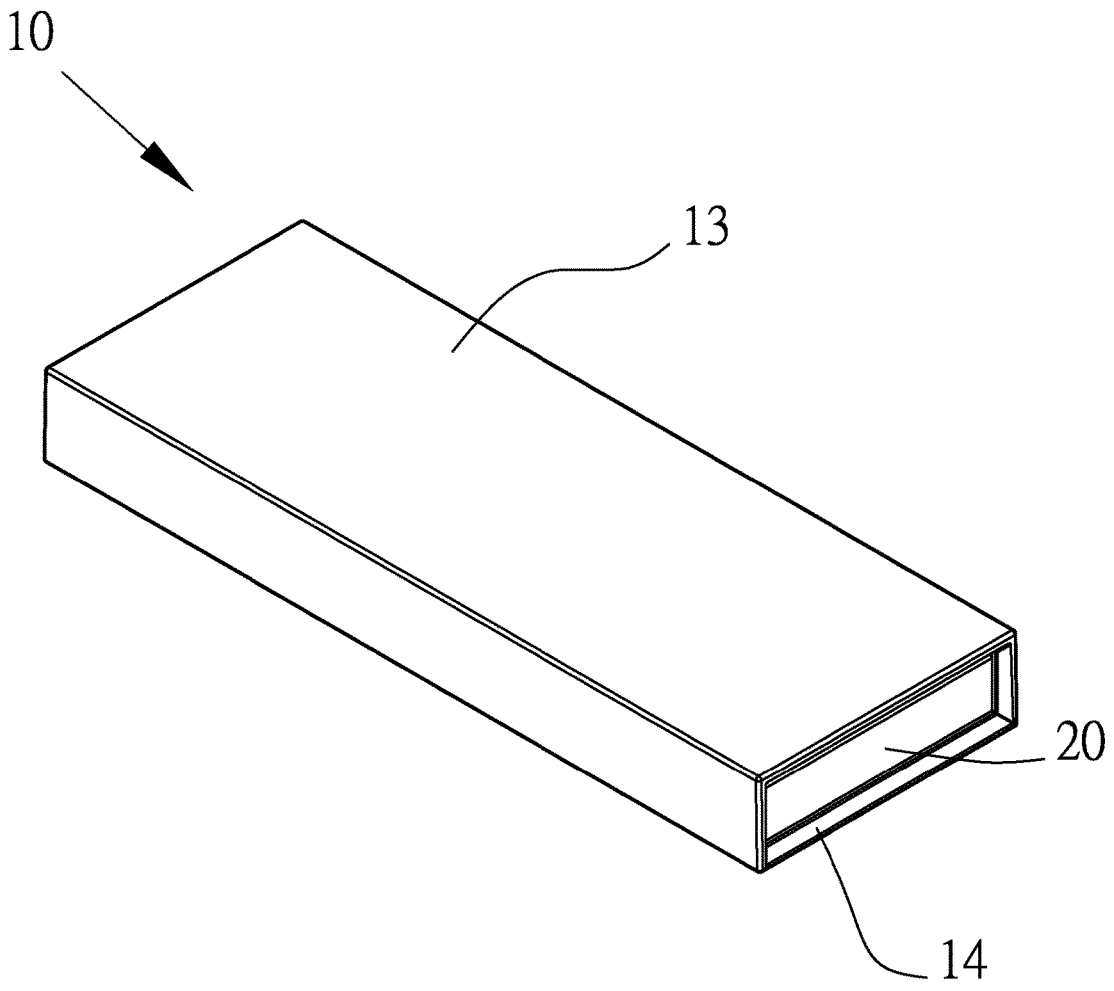
FIG. 2 is a perspective view of the cosmetic powder box according to the present invention.

With reference to FIG. 1, the outer box 10 includes a top cover 131 having two longitudinal sides and two sidewalls 132 integrally extending downwards from the two longitudinal sides, respectively. The outer box 10 further includes a bottom board 14 fixed to a lower end of each sidewall 132 of the top cover 131. Alternatively, the outer box 10 can include a top cover having two longitudinal sides, two sidewalls integrally extending downwards from the two longitudinal sides, respectively, and a bottom wall integrally formed with a lower end of each of the two sidewalls.

The inner box 20 is received in the outer box 10. The inner box 20 includes a top side having a plurality of grooves 21 adapted for receiving cosmetic items (e.g., cosmetic powders), of different colors, types, and characteristics. The inner box 20 is slideable relative to the outer box 10 along the longitudinal axis between a retracted position received in the outer box 10 and an extended position partially exposed on a left side or a right side of the outer box 10. The inner box 20 further includes a bottom side opposite to the top side. A second magnetically attractive member 22 is embedded in each of two ends of the bottom side of the inner box 20. Each second magnetically attractive member 22 is aligned with and in magnetic attraction with one of the first magnetically attractive members 12 when the inner box 20 is in the retracted position. One of the second magnetically attractive members 22 is aligned with and in magnetic attraction with the other of the first magnetic members 12 when the inner box 20 is in the extended position. The first magnetically attractive members 12 can be magnets. Likewise, the second magnetically attractive members 22 can be magnets. In a case that the first magnetically attractive members 12 or the second magnetically attractive members 22 are magnets, the corresponding second or first magnetically attractive members 22, 12 can be made of any material attractive by the magnets.

In embodiments, the number of the magnets 12 and 22 utilized may be a total within the range of 4 to 12. Additionally, the magnets 12 or 22 may include dimensions of a diameter within the range of 4 mm (millimeter) to 6 mm (millimeter); and a thickness within the range of 1.4 mm (millimeter) to 2 mm (millimeter). The weight of the magnets 12 or 22 may be within the range of 0.1 g (grams) to 0.6 g (grams). Further still, the magnets 12 or 22 may have a magnetic attraction within the range of 30 (Gauss) to 50 (Gauss).

Each of the two ends of the bottom side of the inner box 20 includes an embedding groove 23. Each second magnetically attractive member 22 is embedded in one of the embedding grooves 23. A space 25 is defined immediately above the second magnetically attractive member 22 when it is coupled within the embedding groove 23. Each embedding groove 23 is formed by (1) extending from a first mid-point of the height H and perpendicular to the width W, and then extending semi-circumferentially downwards parallel to the height H, and (2) by extending from the length L at a second mid-point of the height H, and then extending semi-circumferentially downwards parallel to the height H. The embedding groove 23 and the space 25 form a counterbore shape. The space 25 may be utilized as a well for receiving adhesive, wherein the adhesive operates to fixedly couple the second magnetically attractive member 22 within the embedding groove 23, thereby embedding the second magnetically attractive member 22 within the inner box.

The outer box 10 includes a bottom wall having two ends. An embedding groove 15 is defined in each of the two ends of the bottom wall of the outer box 10. Each first magnetically attractive member 12 is embedded in one of the embedding grooves 15.

Figure 3A:
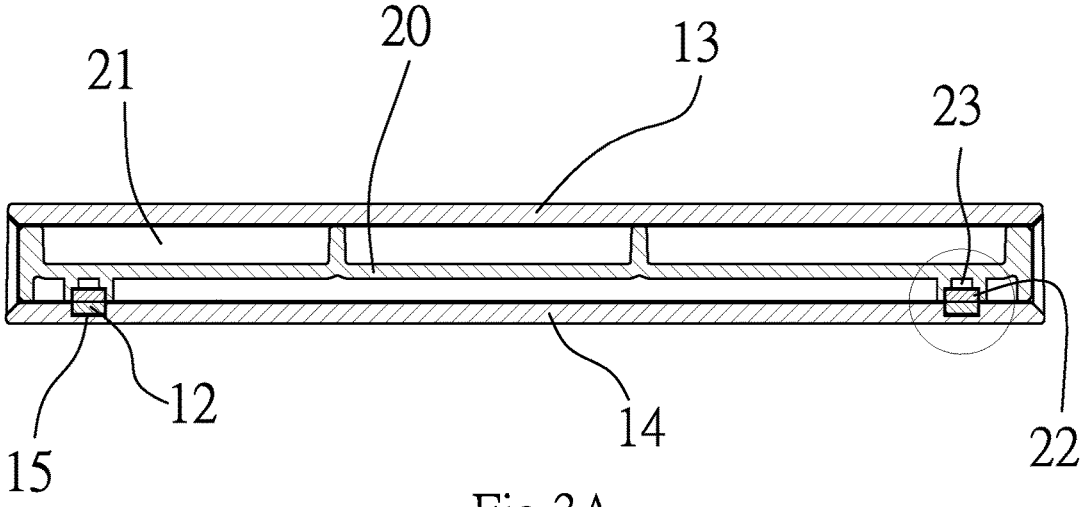
FIG. 3A is an enlarged portion of a circled portion of FIG. 3.
Figure 3:
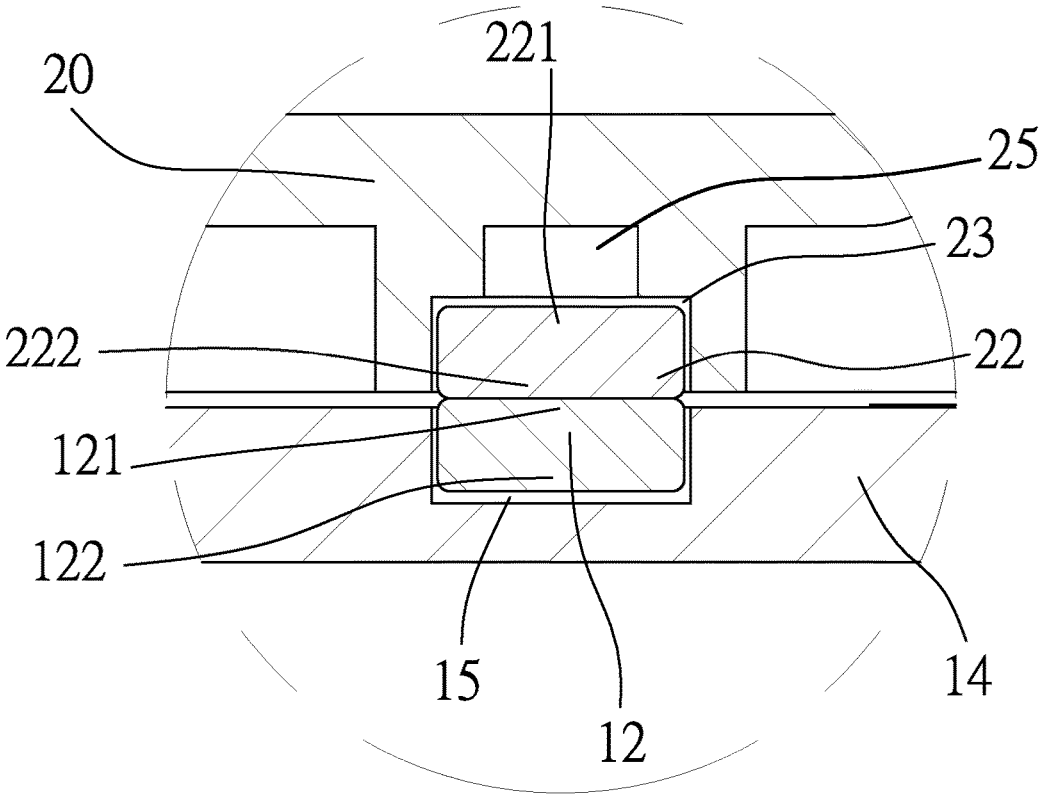
FIG. 3 is a cross sectional view of the cosmetic powder box of FIG. 2.
Figure 4A:
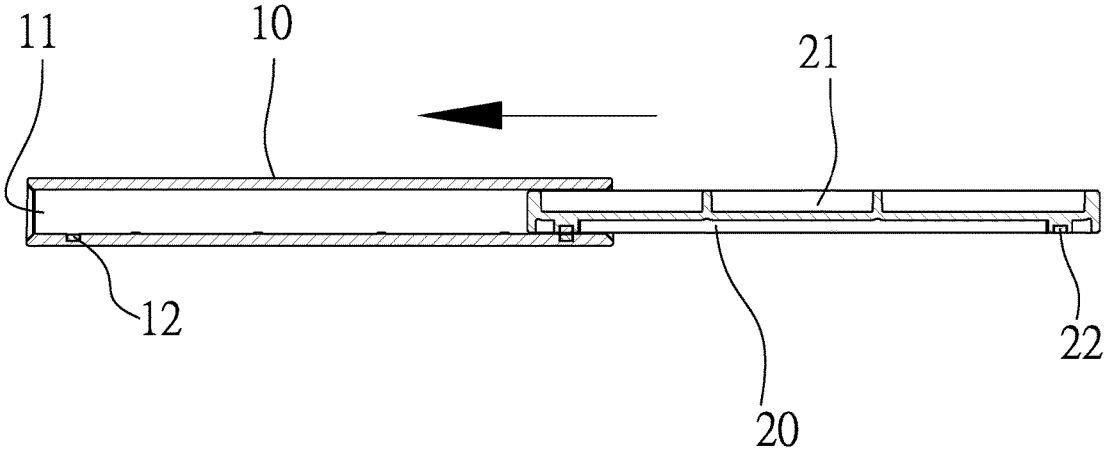
FIG. 4A is a cross sectional view of the cosmetic powder box of FIG. 4.
Figure 4:
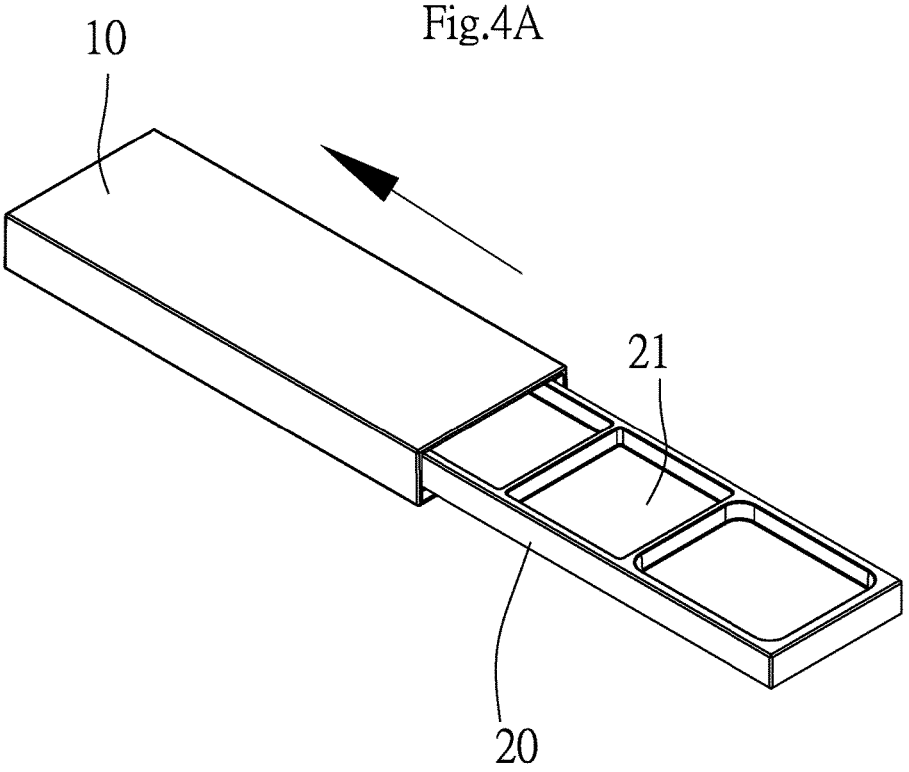
FIG. 4 is a perspective view of the cosmetic powder box of FIG. 2, with an inner box in an extended position on the right side of an outer box.
Figure 5A:
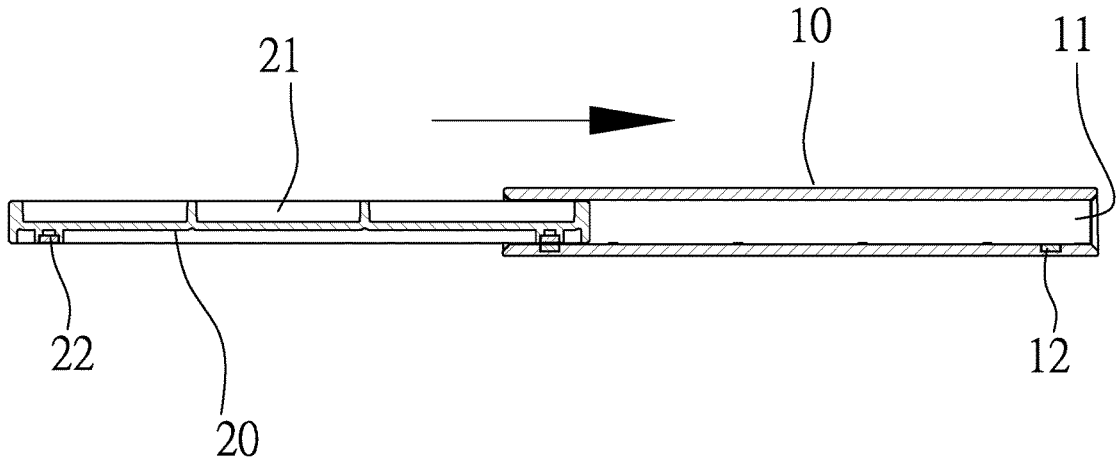
FIG. 5A is a cross sectional view of the cosmetic powder box of FIG. 5.
Figure 5:
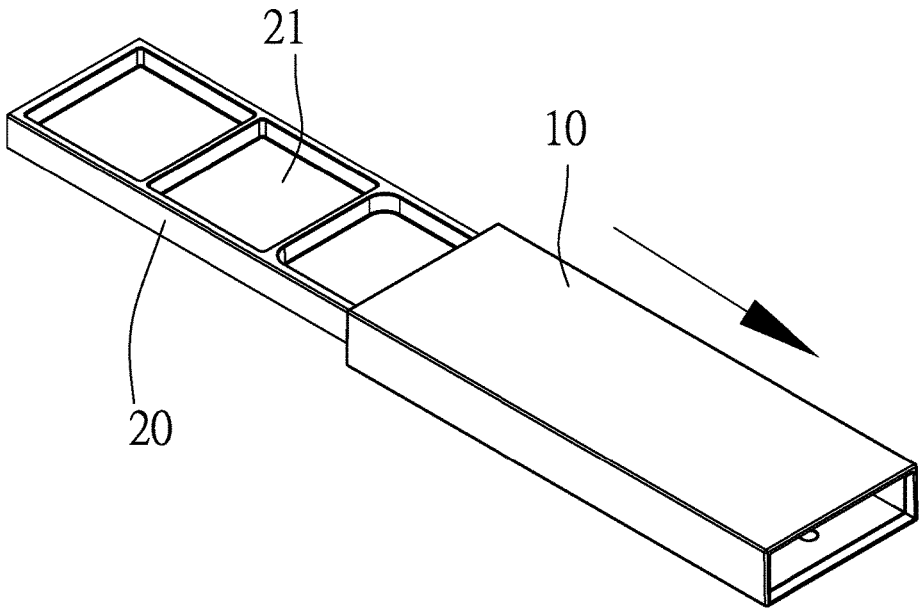
FIG. 5 is a perspective view of the cosmetic powder box of FIG. 2, with the inner box in an extended position on the left side of the outer box.

With reference to FIGS. 3 and 3A, each second magnetically attractive member 22 is aligned with and in magnetic attraction with one of the first magnetically attractive members 12 when the inner box 20 is in the retracted position.

With reference to FIGS. 4, 4A, 6B, and 7B, when the inner box 20 is moved to the extended position on the right side of the outer box 10, the left second magnetically attractive member 22 is aligned with and in magnetic attraction with the right first magnetic member 12. With reference to FIGS. 5, 5A, 6A, and 7A, when the inner box 20 is moved to the extended position on the left side of the outer box 10, the right second magnetically attractive member 22 is aligned with and in magnetic attraction with the left first magnetic member 12.

Figure 6A:
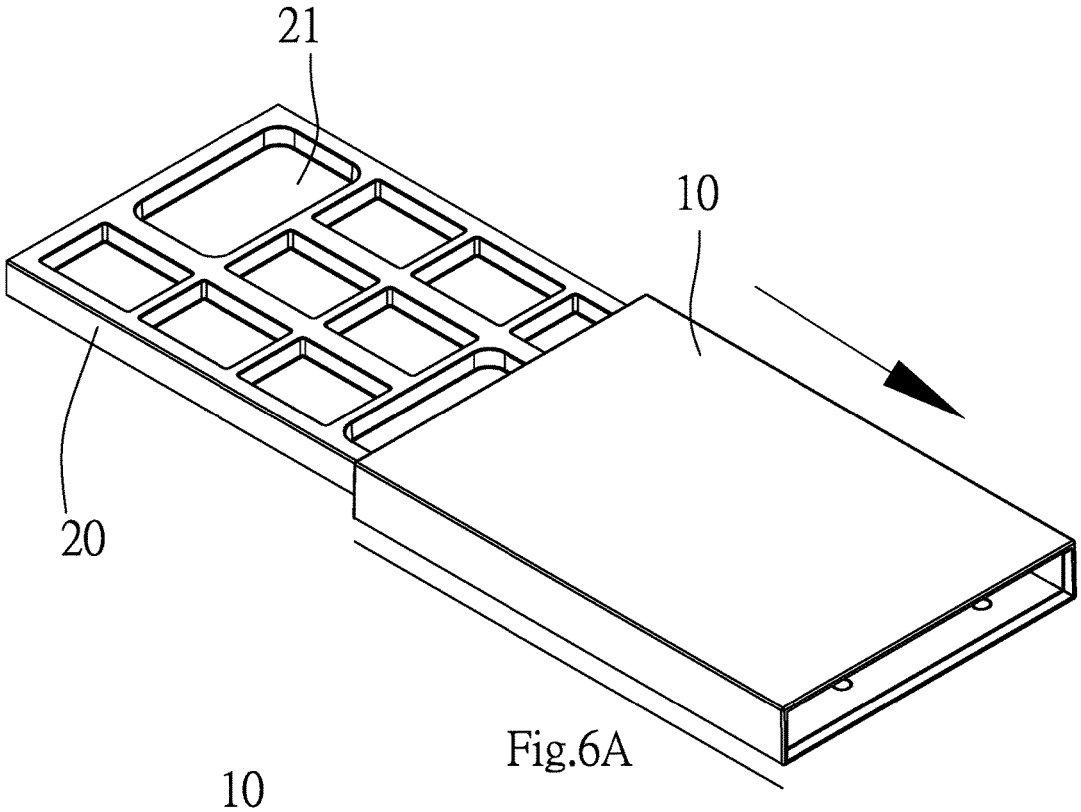
FIG. 6A is a perspective view of a cosmetic powder box of another example according to the present invention, with the inner box in an extended position on the left side of the outer box.
Figure 6B:
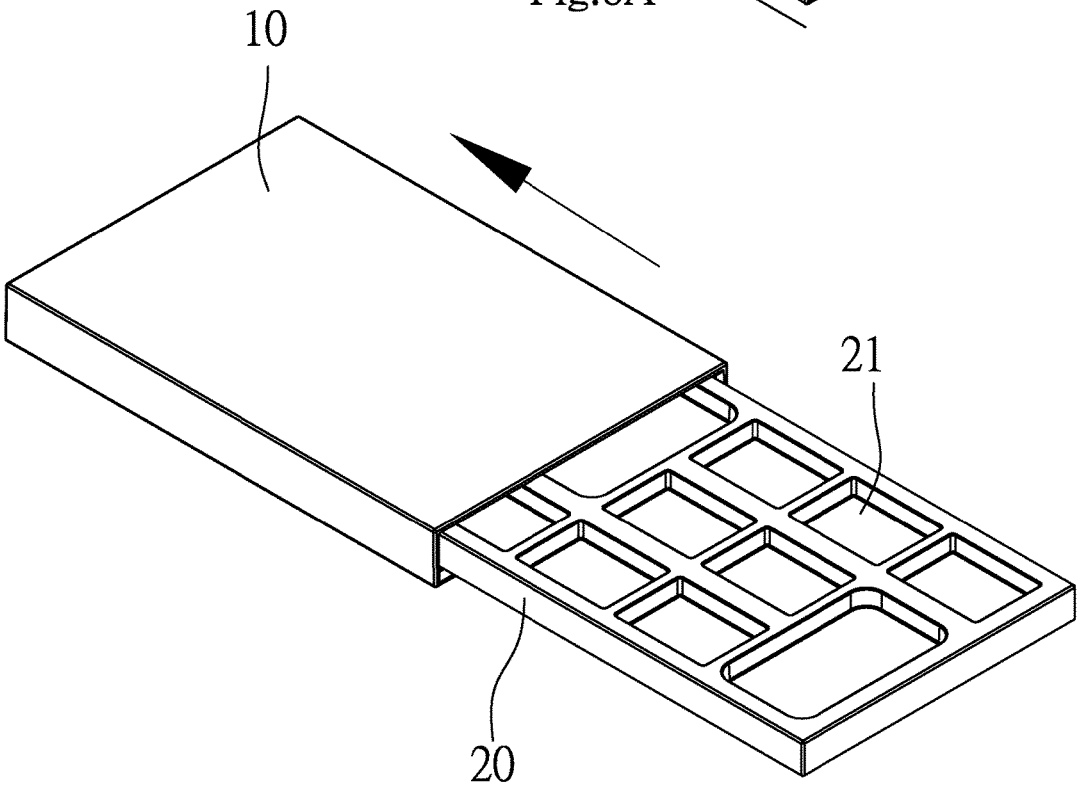
FIG. 6B is a perspective view of the cosmetic powder box of FIG. 6A, with the inner box in an extended position on the right side of the outer box.
Figure 7A:
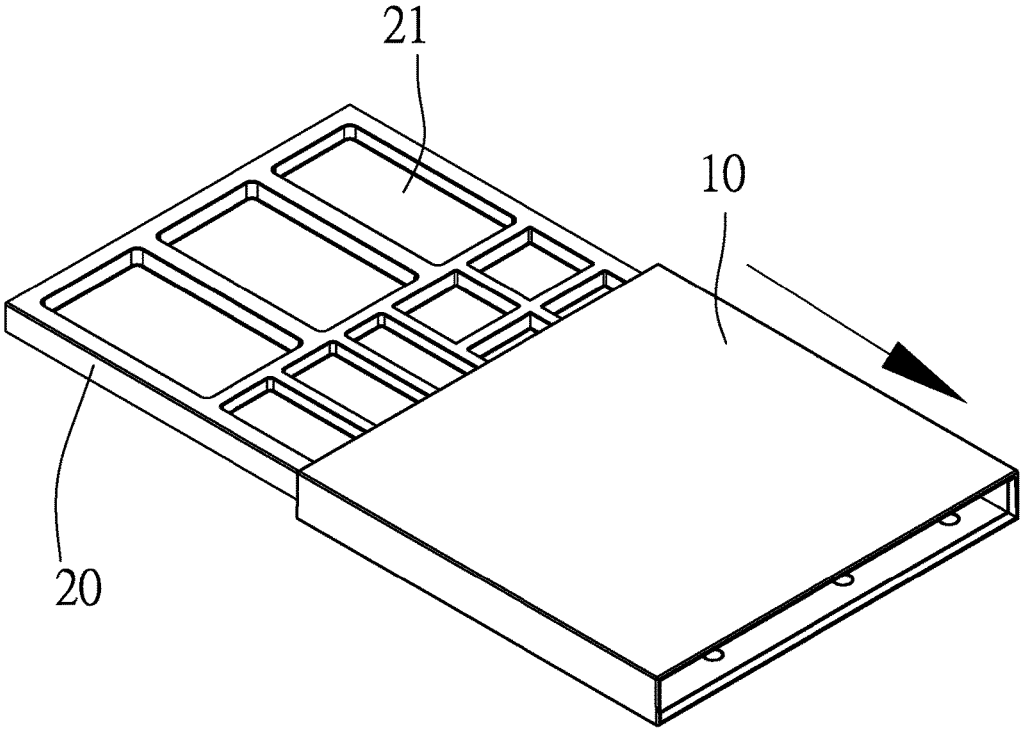
FIG. 7A is a perspective view of a cosmetic powder box of a further example according to the present invention, with the inner box in an extended position on the left side of the outer box.
Figure 7B:
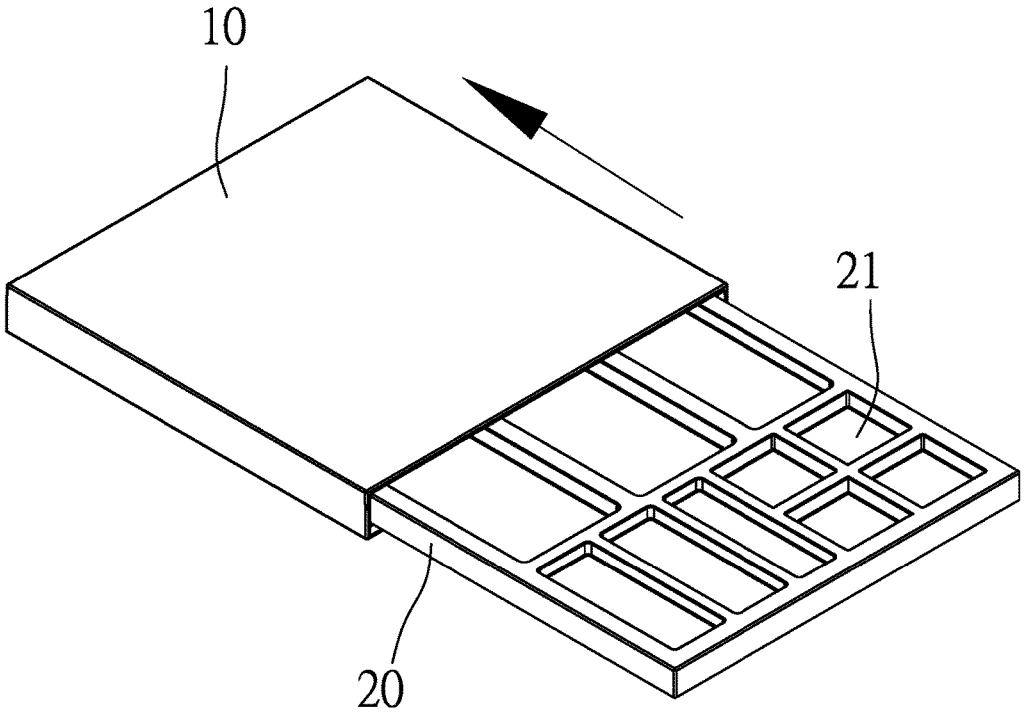
FIG. 7B is a perspective view of the cosmetic powder box of FIG. 7A, with the inner box in an extended position on the right side of the outer box.

With reference to FIG. 1, the top side of the inner box 20 includes three grooves 21 arranged in a row. With reference to FIGS. 6A and 6B, the grooves 21 in the top side of the inner box 20 includes ten grooves 21 arranged in three rows and four columns. Two grooves 21 in each of the first and fourth rows merge into a larger groove larger than the remaining grooves 21. With reference to FIGS. 7A and 7B, the grooves 21 in the top side of the inner box 20 are arranged in two columns. A first one of the two columns includes five rows. The first and second rows of the five rows includes two grooves 21. Each of the remaining three rows of the five rows includes only one groove 21. A second one of the two columns includes three rows each having only one groove 21. Thus, ten grooves 21 are provided.

The perimeter wall of the outer box 10 includes an inner perimeter wall face having two inner vertical surfaces and top and bottom inner surfaces perpendicular to the two inner vertical surfaces. The inner box 20 includes two inner vertical faces perpendicular to the top and bottom sides of the inner box 20. One of the two inner vertical surfaces and the top and bottom inner surfaces of the outer box 10 can include one of a sliding groove and a protrusion. One of the two inner vertical faces and the top and bottom sides of the inner box 20 can include the other of the sliding groove and the protrusion. The protrusion is slideably received in the sliding groove. The sliding groove and the protrusion are configured to permit the inner box 20 to slide relative to the outer box 10 between the retracted position and the extended position while preventing the inner box 20 from disengaging from the outer box 10. Thus, the cosmetic powder box can be operated even if the first and second magnetically attractive members 10 and 20 lose their magnetism.

In view of the foregoing, the cosmetic powder box according to the present invention provides an easy, reliable positioning effect by using first and second magnetically attractive members 12 and 22 while permitting slideable movement between the inner and outer boxes 10 and 20.

Although specific embodiments have been illustrated and described, numerous modifications and variations are still possible without departing from the scope of the invention. The scope of the invention is limited by the accompanying claims.

The invention claimed is:

1. A cosmetic powder box comprising:

an outer box including two ends spaced from each other along a longitudinal axis, with the outer box being tubular and having rectangular cross sections, the outer box including a longitudinal hole having two openings in the two ends of the outer box, and a first magnetically attractive member embedded in a perimeter wall defining each of the two openings;

an inner box of a length L, an inner box width W, and a height H, received in the outer box, with the inner box including a top side having a plurality of grooves adapted for receiving cosmetic items, the inner box slideable relative to the outer box along the longitudinal axis between a retracted position received in the outer box and an extended position partially exposed on a left side or a right side of the outer box, the inner box further including a bottom side opposite to the top side, wherein the bottom side has a width perpendicular to the longitudinal axis, and each of the two ends of the inner box extends perpendicularly to the longitudinal axis to embed a second magnetically attractive member in a middle along the width of each of two ends of the bottom side of the inner box, and a space is defined immediately above the second magnetically attractive member, each of the two ends including an embedding groove for receiving the second magnetically attractive member, wherein each embedding groove is formed i) by a wall extending from a first mid-point of the height H and perpendicular to the width W and forming a groove, and then extending semi-circumferentially downwards parallel to the height H, and ii) by a wall extending from the length L at a second mid-point of the height H, and then extending semi-circumferentially downwards parallel to the height H and forming a groove, the embedding groove and the space immediately above the second magnetically attractive member forming a counterbore shape, wherein the space immediately above the second magnetically attractive member is configured to contain adhesive for further securing the second magnetically attractive member within the embedding groove, each second magnetically attractive member aligned with and in magnetic attraction with one of the first magnetically attractive members when the inner box is in the retracted position, and one of the second magnetically attractive members aligned with and in magnetic attraction with another of the first magnetic members when the inner box is in the extended position.

2. The cosmetic powder box as claimed in claim 1, with the outer box including a top cover having two longitudinal sides and two sidewalls integrally extending downwards from the two longitudinal sides, respectively, and the outer box further including a bottom board fixed to a lower end of each of the two sidewalls of the top cover.

3. The cosmetic powder box as claimed in claim 1, with the outer box including a top cover having two longitudinal sides, two sidewalls integrally extending downwards from the two longitudinal sides, respectively, and a bottom wall integrally formed with a lower end of each of the two sidewalls.

4. The cosmetic powder box as claimed in claim 1, with the outer box including a bottom wall having two ends, with an embedding groove defined in each of the two ends of the bottom wall of the outer box, and each first magnetically attractive member embedded in one of the embedding grooves.

5. The cosmetic powder box as claimed in claim 1, with the perimeter wall of the outer box including an inner perimeter wall face having two inner vertical surfaces and top and bottom inner surfaces perpendicular to the two inner vertical surfaces, the inner box including two inner vertical faces perpendicular to the top and bottom sides of the inner box, one of the two inner vertical surfaces and the top and bottom inner surfaces of the outer box including one of a sliding groove and a protrusion, one of the two inner vertical faces and the top and bottom sides of the inner box including another of the sliding groove and the protrusion, the protrusion slideably received in the sliding groove, and the sliding groove and the protrusion configured to permit the inner box to slide relative to the outer box between the retracted position and the extended position while preventing the inner box from disengaging from the outer box.

6. The cosmetic powder box as claimed in claim 1, wherein the plurality of grooves in the top side of the inner box includes three grooves arranged in a row.

7. The cosmetic powder box as claimed in claim 1, with the plurality of grooves in the top side of the inner box including ten grooves arranged in three rows and four columns, and two grooves in each of the first and fourth rows merged into a larger groove larger than remaining grooves.

8. The cosmetic powder box as claimed in claim 1, with the plurality of grooves in the top side of the inner box arranged in two columns, a first one of the two columns including five rows, first and second rows of the five rows including two grooves, each of remaining three rows of the five rows including only one groove, and a second one of the two columns including three rows each having only one groove, providing ten grooves in total.

9. A cosmetic powder box comprising:

an outer box including two ends spaced from each other along a longitudinal axis, with the outer box being tubular and having rectangular cross sections, the outer box including a longitudinal hole having two openings in the two ends of the outer box, the longitudinal hole defining an inner perimeter, and a first magnetically attractive member embedded in a perimeter wall defining each of the two openings;

an inner box of a length L, an inner box width W, and a height H, to form a perimeter corresponding to the inner perimeter defined by the longitudinal hole of the outer box, received in the outer box, with the inner box including a top side having a plurality of grooves adapted for receiving cosmetic items, the inner box slideable relative to the outer box along the longitudinal axis between a retracted position received in the outer box and an extended position partially exposed on a left side or a right side of the outer box, the inner box further including a bottom side opposite to the top side, wherein the bottom side has a width perpendicular to the longitudinal axis, and each of the two ends of the inner box extends perpendicularly to the longitudinal axis to embed a second magnetically attractive member in a middle along the width of each of two ends of the bottom side of the inner box, and a space is defined immediately above the second magnetically attractive member, each of the two ends including an embedding groove for receiving the second magnetically attractive member, wherein each embedding groove is formed i) by a wall extending from a first mid-point of the height H and perpendicular to the width W and forming a groove, and then extending semi-circumferentially downwards parallel to the height H, and ii) by a wall extending from the length L at a second mid-point of the height H, and then extending semi-circumferentially downwards parallel to the height H and forming a groove, the embedding groove and the space immediately above the second magnetically attractive member forming a counterbore shape, wherein the space immediately above the second magnetically attractive member contains adhesive for securing the second magnetically attractive member within the embedding groove, each second magnetically attractive member aligned with and in magnetic attraction with one of the first magnetically attractive members when the inner box is in the retracted position, and one of the second magnetically attractive members aligned with and in magnetic attraction with another of the first magnetic members when the inner box is in the extended position, wherein engagement of the inner perimeter of the outer box with the perimeter of the inner box aligns the second magnetically attractive members with the first magnetically attractive members in the retracted position and aligns one of the second magnetically attractive members with another of the first magnetic members in the extended position.

10. The cosmetic powder box as claimed in claim 9, with the outer box including a top cover having two longitudinal sides and two sidewalls integrally extending downwards from the two longitudinal sides, respectively, and the outer box further including a bottom board fixed to a lower end of each of the two sidewalls of the top cover.

11. The cosmetic powder box as claimed in claim 9, with the outer box including a top cover having two longitudinal sides, two sidewalls integrally extending downwards from the two longitudinal sides, respectively, and a bottom wall integrally formed with a lower end of each of the two sidewalls.

12. The cosmetic powder box as claimed in claim 9, with the outer box including a bottom wall having two ends, with an embedding groove defined in each of the two ends of the bottom wall of the outer box, and each first magnetically attractive member embedded in one of the embedding grooves.

13. The cosmetic powder box as claimed in claim 9, with the perimeter wall of the outer box including an inner perimeter wall face having two inner vertical surfaces and top and bottom inner surfaces perpendicular to the two inner vertical surfaces, the inner box including two inner vertical faces perpendicular to the top and bottom sides of the inner box, one of the two inner vertical surfaces and the top and bottom inner surfaces of the outer box including one of a sliding groove and a protrusion, one of the two inner vertical faces and the top and bottom sides of the inner box including another of the sliding groove and the protrusion, the protrusion slideably received in the sliding groove, and the sliding groove and the protrusion configured to permit the inner box to slide relative to the outer box between the retracted position and the extended position while preventing the inner box from disengaging from the outer box.

14. The cosmetic powder box as claimed in claim 9, wherein the plurality of grooves in the top side of the inner box includes three grooves arranged in a row.

15. The cosmetic powder box as claimed in claim 9, with the plurality of grooves in the top side of the inner box including ten grooves arranged in three rows and four columns, and two grooves in each of the first and fourth rows merged into a larger groove larger than remaining grooves.

16. The cosmetic powder box as claimed in claim 9, with the plurality of grooves in the top side of the inner box arranged in two columns, a first one of the two columns including five rows, first and second rows of the five rows including two grooves, each of remaining three rows of the five rows including only one groove, and a second one of the two columns including three rows each having only one groove, providing ten grooves in total.

17. The cosmetic powder box as claimed in claim 9, wherein the first magnetically attractive members and the second magnetically attractive members are magnets.

18. The cosmetic powder box as claimed in claim 17, wherein the total number of first magnetically attractive members and second magnetically attractive members is within the range of 4 to 12.

19. The cosmetic powder box as claimed in claim 18, wherein each of the first magnetically attractive members and each of the second magnetically attractive members has (i) a diameter within the range of 4 mm (millimeter) to 6 mm (millimeter); (ii) a thickness within the range of 1.4 mm (millimeter) to 2 mm (millimeter); and (iii) a weight within the range of 0.1 g (grams) to 0.6 g (grams).

20. The cosmetic powder box as claimed in claim 19, wherein each of the first magnetically attractive members and each of the second magnetically attractive members has a magnetic attraction within the range of 30 (Gauss) to 50 (Gauss).

* * * * *